US009333746B2

(12) United States Patent
Nagamochi et al.

(10) Patent No.: US 9,333,746 B2
(45) Date of Patent: May 10, 2016

(54) INK JET RECORDING HEAD SUBSTRATE, METHOD FOR MANUFACTURING THE SAME, AND INK JET RECORDING HEAD

(71) Applicant: CANON KABUSHIKI KAISHA, Tokyo (JP)

(72) Inventors: Soichiro Nagamochi, Kawasaki (JP); Shuichi Tamatsukuri, Asaka (JP); Souta Takeuchi, Fujisawa (JP); Kenji Takahashi, Yokohama (JP); Sadayoshi Sakuma, Oita (JP); Hirokazu Komuro, Yokohama (JP); Makoto Sakurai, Kawasaki (JP); Yuzuru Ishida, Yokohama (JP); Takeru Yasuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/789,866

(22) Filed: Jul. 1, 2015

(65) Prior Publication Data

US 2016/0009088 A1 Jan. 14, 2016

(30) Foreign Application Priority Data

Jul. 8, 2014 (JP) ..... 2014-140397

(51) Int. Cl.

| | |
|---|---|
| ***B41J 2/155*** | (2006.01) |
| ***B41J 2/14*** | (2006.01) |
| ***B41J 2/16*** | (2006.01) |

(52) U.S. Cl.

CPC ..... *B41J 2/14088* (2013.01); *B41J 2/1601* (2013.01); *B41J 2/1628* (2013.01); *B41J 2/1631* (2013.01); *B41J 2/1642* (2013.01); *B41J 2/1646* (2013.01)

(58) Field of Classification Search

CPC ..... B41J 2/1433; B41J 2/162; B41J 2002/14419; B41J 2/14274; B41J 2/145; B41J 2002/14491

See application file for complete search history.

(56) References Cited

U.S. PATENT DOCUMENTS

| | | | | |
|---|---|---|---|---|
| 7,390,078 | B2 | 6/2008 | Bell et al. | |
| 2007/0109372 | A1 * | 5/2007 | Tomioka | B41J 2/14072 347/86 |
| 2008/0151028 | A1 * | 6/2008 | Yamakami | B41J 2/14024 347/100 |

* cited by examiner

*Primary Examiner* — Lamson Nguyen
(74) *Attorney, Agent, or Firm* — Canon U.S.A., Inc., IP Division

(57) ABSTRACT

An ink jet recording head substrate is provided which includes a base substrate, a heat accumulation layer overlying the base substrate, a heating resistor layer including an electrothermal conversion portion and overlying the heat accumulation layer, a wiring layer electrically connected to the heating resistor layer, and an insulating protective layer covering the heating resistor layer and the wiring layer. The heat accumulation layer includes a porous cyclic siloxane film.

20 Claims, 6 Drawing Sheets

INK JET RECORDING HEAD SUBSTRATE, METHOD FOR MANUFACTURING THE SAME, AND INK JET RECORDING HEAD

BACKGROUND OF THE INVENTION

1. Field of the Invention

The present application relates to a substrate for an ink jet recording head adapted to record information by ejecting an ink onto an ink jet recording medium, and a method for manufacturing the same. This substrate is hereinafter referred to as the ink jet recording head substrate. The present application also relates to an ink jet recording head including the ink jet recording head substrate.

2. Description of the Related Art

A thermal ink jet recording head has recently been desired which can operate at low power with reliability. A thermal ink jet recording head (hereinafter simply referred to as the ink jet recording head) includes an element substrate for the ink jet recording head, and a liquid flow channel member having an ink chamber and ink ejection openings communicating with the ink chamber. The element substrate is provided with a heating resistor that applies heat for generating bubbles in an ink that are the energy for ejecting the ink. The heating resistor is provided with a protective layer thereon for preventing the heating resistor from coming into contact with the ink. In addition, an insulating layer is disposed between the base member, such as a silicon substrate, of the element substrate and the heating resistor. It is effective in operating the ink jet recording head at low power to reduce the thermal conductivity of the insulating layer disposed between the heating resistor and the semiconductor substrate, or base member. The insulating layer on the semiconductor substrate is generally made of silicon oxide having a thermal conductivity of 1.3 $W \cdot m^{-1} \cdot K^{-1}$. An insulating layer having a lower thermal conductivity than silicon oxide, that is, a heat accumulation layer is desired.

In the case of using a heat accumulation layer having a low thermal conductivity, heat generated from the heating resistor does not easily dissipate in the direction of the semiconductor substrate through the heat accumulation layer. This is efficient in increasing the temperature of the thermal operation portion, which will come into contact with the ink, on the heating resistor, accordingly reducing the energy applied for bubbling the ink. Consequently, the resulting recording head can operate at low power.

The ink jet recording head disclosed in U.S. Pat. No. 7,390,078 includes an insulating layer 28, a heat accumulation layer (low thermal diffusivity film) 32, a heating resistor layer 26, a covering layer (electroconductive metal layer) 60 and a protective layer 30 on a substrate 22, as shown in FIG. 5. In this head, the plane between the protective layer 60 and the heating resistor layer 26 acts as a fluid ejector actuator 17. The insulating layer 28 is made of, for example, silicon oxide or silicon nitride, and the heat accumulation layer 32 is made of an aerogel of a ceramic oxide, such as silica, titania, or alumina. The heat accumulation layer 32 has very small pores of less than 100 nm in pore size, and a low thermal conductivity of about 0.3 to 1 $W \cdot m^{-1} \cdot K^{-1}$. Thus, the ink jet recording head can operate at low power. For the other reference numerals in FIG. 5, see the above-cited U.S. Pat. No. 7,390,078.

SUMMARY OF THE INVENTION

According to an aspect of the application, there is provided an ink jet recording head substrate includes a base substrate, a heat accumulation layer overlying the base substrate, a heating resistor layer overlying the heat accumulation layer and including an electrothermal conversion portion, a wiring layer electrically connected to the heating resistor layer, and an insulating protective layer covering the heating resistor layer and the wiring layer. The heat accumulation layer includes a porous cyclic siloxane film formed by a gas-phase process.

Further features of the present invention will become apparent from the following description of exemplary embodiments with reference to the attached drawings.

DESCRIPTION OF THE EMBODIMENTS

The aerogel forming the heat accumulation layer 32 disclosed in U.S. Pat. No. 7,390,078 is prepared by a sol-gel process using a reaction, such as hydrolysis or polycondensation, of the material solution. The aerogel is applied onto a base substrate, and is then heat-treated to remove the remaining solvent in the coating, thus being densified.

In this process, however, it is difficult to completely remove the solvent. The solvent can remain to some extent. In particular, in the case of forming a heat accumulation layer on a substrate having semiconductor elements or the like, long-time heat treatment, which can adversely affect the semiconductor elements, is limited. If such a residual solvent remains in the heat accumulation layer, the residual solvent can be evaporated by the heat of the heat accumulation layer generated when the ink jet recording head has been operated. The evaporation of the residual solvent causes the heat accumulation layer to expand and contract and thus breaks the heat accumulation layer. Consequently, the heating resistor layer might be broken, and the head might not work due to an open circuit.

Accordingly, an aspect of the present application provides an ink jet recording head that can operate at low power with reliability.

Figure 4A:
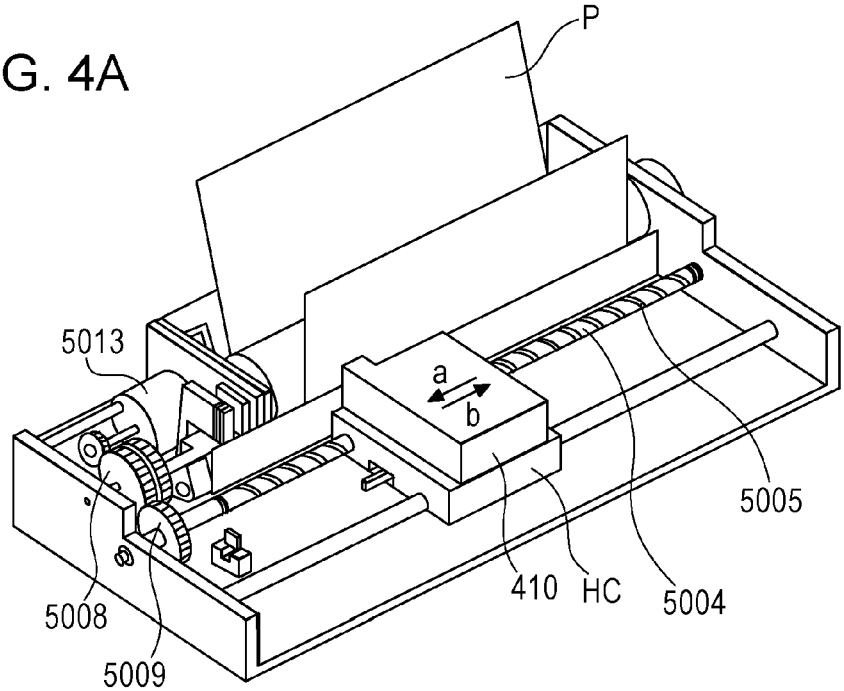
FIG. 4A is a schematic perspective view of an ink jet recording apparatus that can incorporate the ink jet recording head according to an embodiment of the application.

Exemplary embodiments of the application will now be described in detail with reference to the drawings. Ink Jet Recording Apparatus FIG. 4A is a schematic perspective view of an ink jet recording apparatus capable of incorporating the ink jet recording head according to an embodiment of the application. The ink jet recording apparatus includes a lead screw 5004 that rotates with driving force transmission gears 5008 and 5009 in conjunction with the positive and negative rotation of a driving motor 5013, as shown in FIG. 4A. The ink jet recording apparatus also includes a carriage HC on which an ink jet head unit 410 can be mounted. The carriage has a pin (not shown) engaged in a helical groove 5005 of the lead screw 5004, and is reciprocally moved in the directions indicated by arrows a and b by the rotation of the lead screw 5004.

Ink Jet Recording Head

Figure 4B:
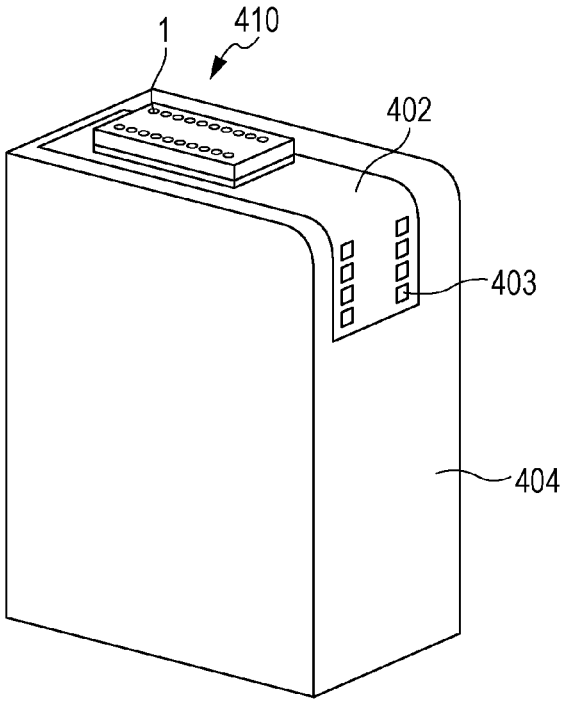
FIG. 4B is a perspective view of an ink jet cartridge that can incorporate the ink jet recording head according to an embodiment of the application.
Figure 4C:
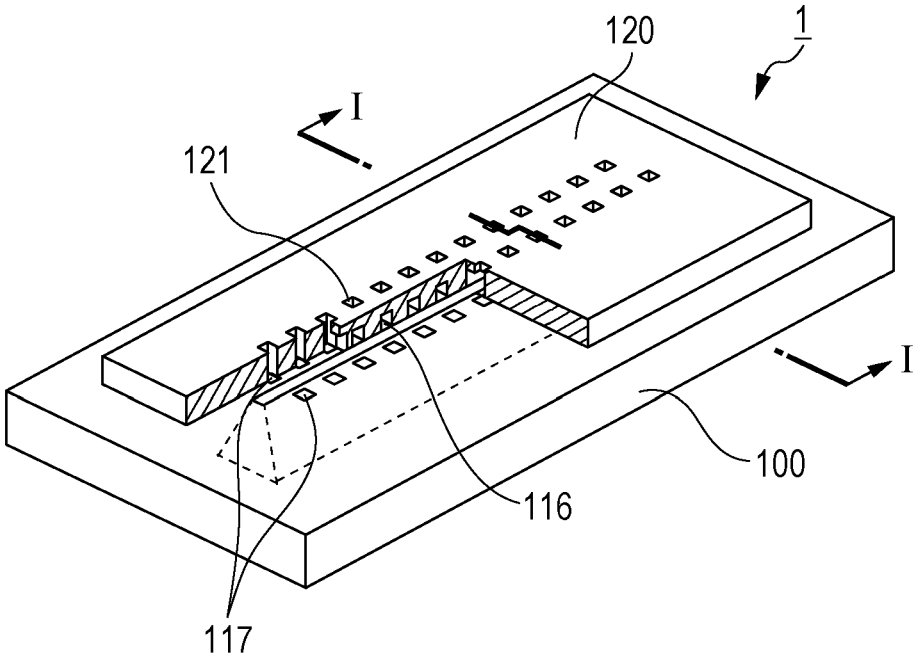
FIG. 4C is a schematic partially cutaway perspective view of an ink jet recording head produced by the manufacturing process according to an embodiment of the application.
Figure 5:
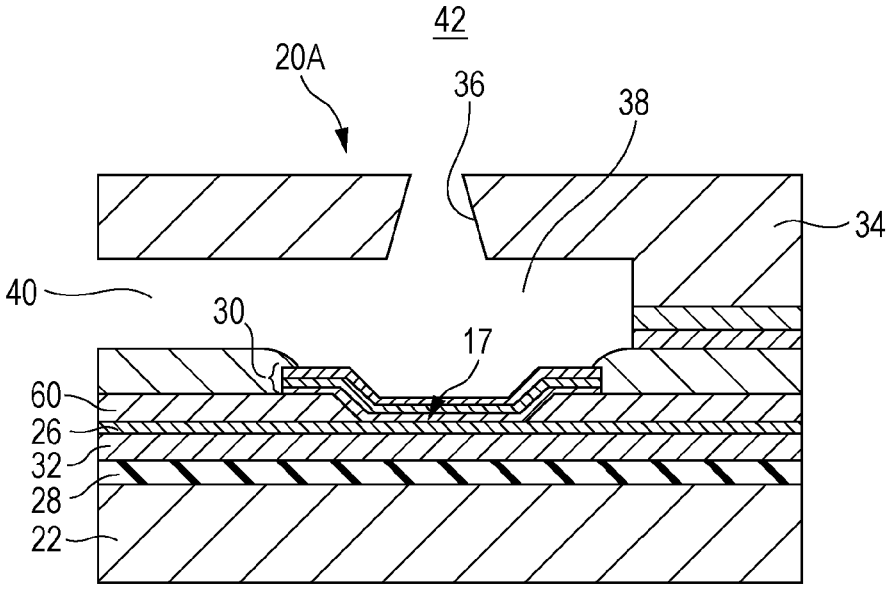
FIG. 5 is a schematic sectional view of an ink jet recording head of the known art.

FIG. 4B is a perspective view of an ink jet heat unit. The ink jet head unit 410 includes an ink jet recording head 1, an ink holder 404 containing an ink to be fed to the ink jet recording head 1. The ink jet recording head 1 and the ink holder 404 are integrated to define an ink jet cartridge. The ink jet recording head 1 is disposed on the surface of the ink jet head unit 410 that will oppose the recording medium P shown in FIG. 4A. The ink jet recording head 1 and the ink holder 404 are not necessarily integrated in one body. For example, the ink holder 404 may be removable. The ink jet head unit 410 also include a tape member 402 for tape automated bonding (TAB) having a terminal thorough which electric power is supplied to the ink jet recording head 1. The tape member 402 enables the communication of electric power or signals with the recording apparatus through contacts 403. FIG. 4C is a schematic partially cutaway perspective view of the ink jet recording head 1 according to an embodiment of the application.

Figure 1A:
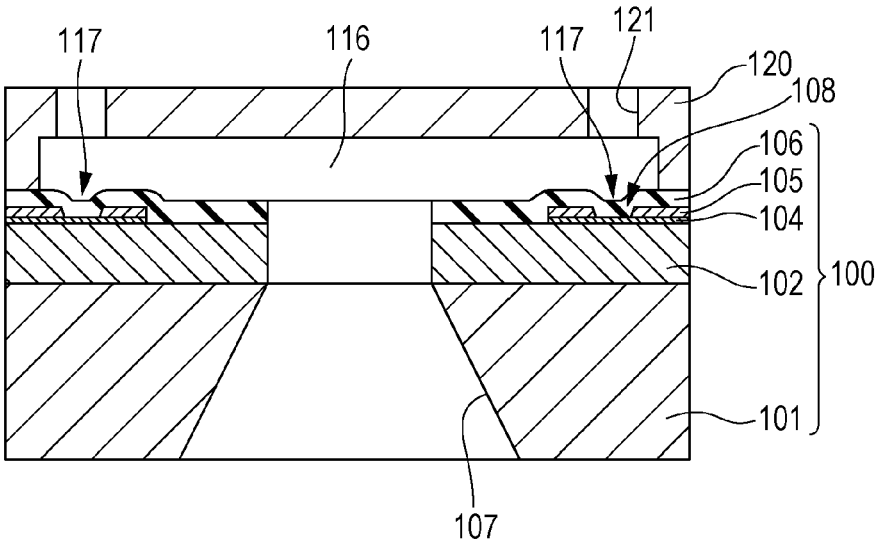
FIGS. 1A and 1B are schematic sectional views of the thermal operation portions and vicinity thereof of an ink jet recording head according to an embodiment of the application, taken along line I-I of FIG. 4C.

FIG. 1A is a schematic sectional view of the thermal operation portions 117 and vicinity thereof of the ink jet recording head 1 of an embodiment, taken along line I-I in FIG. 4C.

Figure 1B:
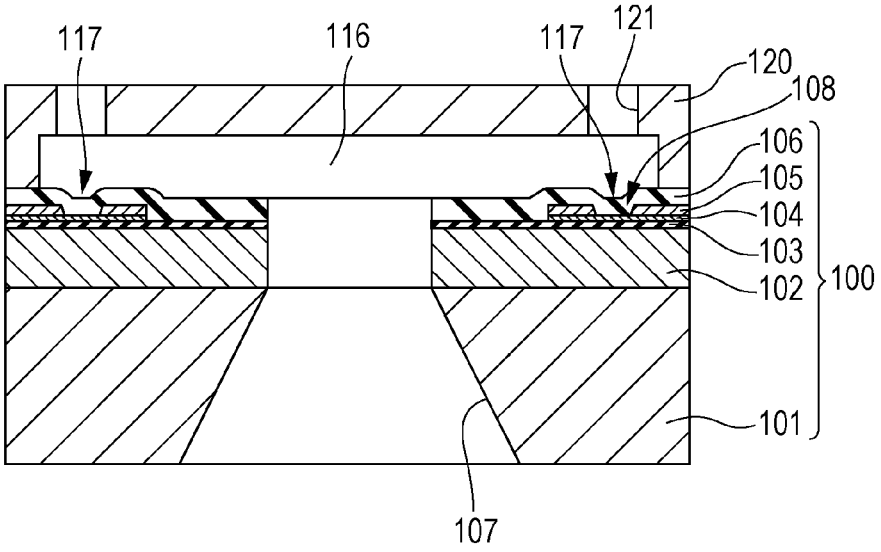

In FIG. 1A, reference numeral 101 designates a base substrate made of, for example, silicon. The base substrate 101 may include switching elements, such as transistors, and conducting lines in the region not shown, and also includes an insulating film covering these elements and conductive lines. FIG. 1A does not show the insulating film and the like for the sake of simplicity. A heat accumulation layer 102 including a cyclic siloxane film is disposed on the base substrate. Reference numeral 104 designates a heating resistor layer, and reference numeral 105 designates a wiring layer made of Al, Al—Si, Al—Cu, or any other metal material. The wiring layer 105 is partially removed to form gaps. The portions of the heating resistor layer 104 exposed in the gaps 104 act as electrothermal conversion portions 108. The wiring layer 105 is connected to a driving element circuit (not shown) or an external power supply terminal (not shown), thus receiving power from the outside. Although the wiring layer 105 shown in FIG. 1 is disposed on the heating resistor layer 104, it is not limited to this structure. For example, the wiring layer 105 having gaps may be formed on the base substrate 101. The heat accumulation layer 102 is disposed on the wiring layer 105, and then the heating resistor layer 104 is disposed on the heat accumulation layer 102. The heat accumulation layer 102 is provided with a contact electrically connecting the heating resistor layer 104 to the wiring layer 105. Alternatively, the wiring layer 105 having gaps may be formed on the heat accumulation layer 102, and the heating resistor layer 104 is disposed on the wiring layer 105 and on the heat accumulation layer 102 in the gaps. Hence, any structure may be taken as long as the wiring layer (electrode) 105 is electrically connected to the heating resistor layer 104. The heating resistor layer 104 and the wiring layer 105 are covered with an insulating protective layer 106 made of silicon oxide, silicon nitride or the like. The portions of the surface of the insulating protective layer 106 right above the electrothermal conversion portions 108 act as thermal operation portions 117.

The ink jet recording head substrate 100 having the above-described structure is provided with a liquid flow channel member 120 thereon. The liquid flow channel member 120 has ink ejection openings 121 corresponding to the positions of the thermal operation portions 117, and a liquid flow channel 116 continuing from an ink supply port 107 passing through the ink jet recording head substrate 100, to the ink ejection openings 121 via the thermal operation portions 117. The ink jet recording head 1 thus includes the ink jet recording head substrate 100 and the liquid flow channel member 120.

The heat accumulation layer 102 formed in the present embodiment includes a cyclic siloxane film. The cyclic siloxane film is formed by a gas-phase process, such as plasma chemical vapor deposition (plasma CVD or P-CVD). The heat accumulation layer 102 may further include an insulating film formed of silicon oxide, silicon nitride or the like on the surface of the base substrate 101. In the following description, the cyclic siloxane film may be referred to simply as the heat accumulation layer 102.

Figure 6:
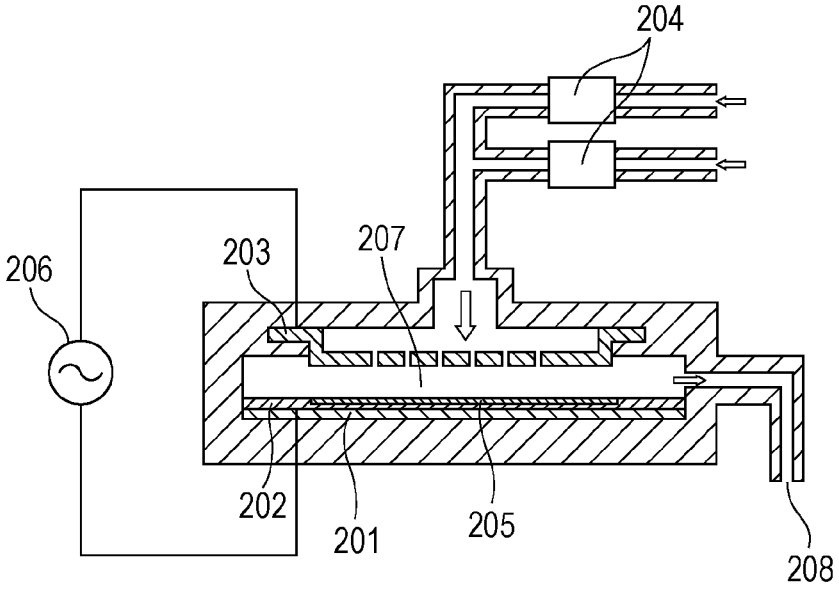
FIG. 6 is a schematic sectional view of a CVD chamber used in the method according to an embodiment of the application.

The P-CVD process will now be described with reference to FIG. 6 showing the section of a P-CVD chamber. FIG. 6 is a schematic sectional view of the P-CVD chamber. At least one process gas is introduced to a deposition chamber 207 through a shower head 203. At this time, the flow rates of the process gases are controlled with their respective mass flow controllers 204. The deposition chamber 207 communicates with an exhaust port 208. Gas is discharged through this exhaust port 208. Subsequently, RF power is applied to the shower head 203 and a top plate 202 from an RF power supply 206, thus forming radicals in the deposition chamber 207 by plasma discharge. Atoms dissociated from part of the plasma or the radicals react chemically with the process gas to form deposit on the surface of the base substrate 205, thus performing deposition. The temperature (deposition temperature) of the top plate 202 can be varied with a heater 201. If deposition is performed, for example, on a base substrate having functional elements at a temperature higher than or equal to room temperature (25° C.), deposition temperature may be appropriately set within a range in which the functional elements or the like are not affected. For example, the deposition may be performed at a temperature of 400° C. or less. As deposition is performed at a higher temperature, the porosity of the deposited film decreases and the mechanical strength increases. The thermal conductivity of the deposited film however tends to decrease. Good balance between porosity and thermal conductivity leads to an effective heat accumulation layer.

Figure 2A:
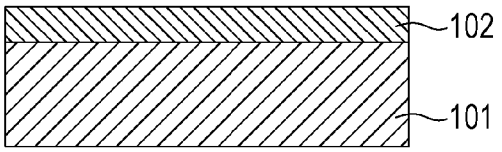
FIGS. 2A to 2E are schematic sectional views illustrating a process for manufacturing the ink jet recording head shown in FIG. 1A.

The heat accumulation layer 102 is formed using at least one process gas (material gas) capable of forming a cyclic siloxane film. The material gas for forming the cyclic siloxane skeleton is introduced into the P-CVD chamber shown in FIG. 6. An inert gas (nitrogen gas or argon gas) may be used as a carrier gas. Then, plasma is generated to break some of the bonds of the material gases, thereby forming a porous cyclic siloxane film (heat accumulation layer 102) having a cyclic siloxane skeleton (FIG. 2A).

The cyclic siloxane mentioned herein is the general term of compounds having a cyclic skeleton expressed by (—Si—O—)n formed with siloxane units (n represents an integer), where Si atoms are bound to O and other atoms. Atoms other than O include H, C, N, and F. Although a normal silicon oxide film also has a —Si—O— cyclic structure, the atoms bound to Si are only O. Some of the glass materials contain Na, Ca or Al. The Na, Ca or the like is however merely held in the SiO cyclic structure, and Al is bound to O. The cyclic siloxane skeleton may have a single cyclic structure or a plurality of cyclic structures. Alternatively, a plurality of cyclic structures may be connected to each other with a linkage structure. The number n of siloxane units of the cyclic siloxane skeleton is preferably 3 to 20. When n is less than 3, the cyclic skeleton is difficult to form. In contrast, when n exceeds 20, the mechanical strength of the film is reduced and results in reduced durability to thermal stress. If the cyclic skeleton contains partially has a —SiNR— or —SiCR—O- bond in the molecule thereof, the siloxane unit may contain these bonds, and the number n of the siloxane units includes the siloxane units containing these bonds.

Process gases capable of forming the cyclic siloxane film include silicon compounds capable of supplying Si, oxidizing gases capable of supplying O, and compounds capable of supplying H, C, N, F, or any other element to the side chain, the cyclic skeleton or the linkage structure. The process gas for introducing such an element may be a single compound gas or a combination of a plurality of gases. A gas having a cyclic siloxane structure may be used as a process gas.

The cyclic siloxane film formed by a gas phase process is porous and has pores of 0.1 nm to 3 nm in size. The pore size can be controlled by selecting the raw material gas used in the gas phase process and the deposition conditions.

In the gas phase process, the structure and porosity of the resulting cyclic siloxane film vary depending on the process gas, the flow rate of the process gas, and deposition conditions including deposition temperature. The variation in porosity affects the physical properties of the resulting film. As the porosity is increased, the thermal conductivity decreases; and as the porosity is reduced, the durability to thermal stress increased. There is a trade-off between the thermal conductivity and the durability to thermal stress. In the present embodiment, it is advantageous for good balance between them to control the porosity of the cyclic siloxane film in a specific range. The porosity may be in the range of 20% to 70%. The optimum porosity depends on the composition of the cyclic siloxane. When it contains Si, O, C and H (hereinafter referred to as SiOCH siloxane), the advantageous porosity is in the range of 30% to 60%. The cyclic siloxane may contain Si, O, F and H (hereinafter referred to as SiOFH siloxane), Si, O, C, H and F (SiOCHF siloxane), or Si, O, C, H, N and F (SiOCHNF siloxane). Advantageously, these cyclic siloxanes have porosities in the range of 30% to 65%. The porosity may be controlled by thermal treatment performed independently after the deposition.

The cyclic siloxane film of the heat accumulation layer 102 may have a thickness of 0.3 μm to 10.0 μm, such as 0.5 μm to 2.0 μm.

If the heating resistor layer 104 or the wiring layer 105 is formed on the thus formed porous cyclic siloxane film (heat accumulation layer 102), the flatness of these layers overlying the cyclic siloxane film may be reduced depending on the pore size of the cyclic siloxane film, and accordingly, the thermal efficiency may be reduced. The material of the overlying layer having a high thermal conductivity may be trapped in the pores, thereby increasing the thermal conductivity of the heat accumulation layer 102. This reduces the effect of the heat accumulation layer 102. It is therefore advantageous that the pores be sealed at the surface of the film so as to ensure the flatness of the heat accumulation layer 102 and prevent foreign matter from entering the pores. For this sealing of the pores, an insulating film (pore-sealing film 103), such as a silicon oxide film or a silicon nitride (SiN) film, may be formed on the surface of the cyclic siloxane film (heat accumulation layer 102), as shown in FIG. 3B. The pore-sealing film 103 is a part of the heat accumulation layer. Note that an excessively thick silicon nitride film increases thermal diffusion in the direction parallel to the surface because the silicon nitride has a higher thermal conductivity than silicon oxide. It is therefore advantageous that the pore-sealing film be formed to a thickness capable of ensuring flatness to some extent, for example, to a thickness of 5 nm to 50 nm.

EXAMPLES

The invention will be further described in detail with reference to Examples. The Application is not however limited to the disclosed examples.

Example 1

The process will now be described which was performed in the present Example for manufacturing an ink jet recording head substrate and an ink jet recording head.

FIGS. 2A to 2E are schematic sectional views illustrating the process for manufacturing the ink jet recording head 1 shown in FIG. 1A.

In the following process, the base substrate 101 may be a simple Si substrate or a substrate including driving elements such as switching transistors for selectively operating the electrothermal conversion portions 108 or other semiconductor elements. For the sake of simplicity, the drawings used in the following description show a simple Si substrate as the base substrate 101.

A heat accumulation layer 102 is formed of a cyclic siloxane to a thickness of 1.5 μm on the base substrate 101 by a gas phase process under the conditions of any one of 1A to 1E shown in Table 1 (FIG. 2A). The deposition was performed using the P-CVD apparatus shown in FIG. 6 at a deposition temperature of 300° C. and an RF power of 700 W. Diethoxymethylsilane expressed by the following formula (A) and norbornadiene expressed by the following formula (B) were used as the material gases.

(A)

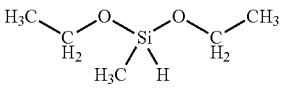

(B)

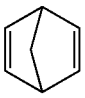

The cyclic siloxane formed from the material gases expressed by formulas (A) and (B) may have the structure as shown in formula (C).

(C)

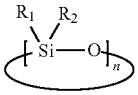

In formula (C), $R_1$ and $R_2$ each represent H, group containing a carbon atom, such as $CH_3$ or $C_2H_5$, or a site bound to another cyclic siloxane structure, such as —$CH_2$— or —O—. Since O, C and H are bound directly to the Si atom, this cyclic siloxane is represented as SiOCH. According to observation through a transmission electron microscope, the pore size was in the range of 0.1 nm to 3 nm. The number n of siloxane units in the cyclic skeleton was estimated in the range of 3 to 20 from the pore size.

Then, a TaSiN heating resistor layer 104 was formed to a thickness of about 50 nm on the heat accumulation layer 102 by reaction sputtering, and, subsequently, an Al layer was formed to a thickness of about 285 nm as the wiring layer 105 by sputtering. The heating resistor layer 104 and the wiring layer 105 were subjected to dry etching using a photolithography technique. In the present Example, the dry etching was performed by reactive ion etching (RIE).

Figure 2B:
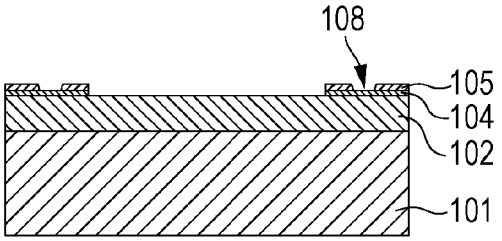

For forming electrothermal conversion portions 108, the Al wiring layer 105 was further removed, in part, by etching using a photolithography technique in such a manner that the heating resistor layer 104 was exposed in the removed portions, as shown in FIG. 2B.

Figure 2C:
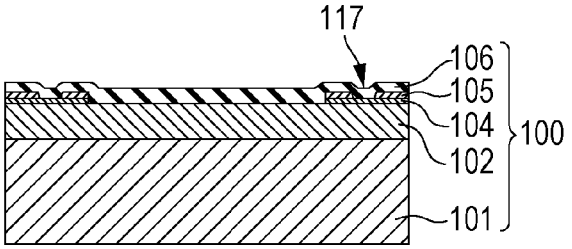

Then, a silicon nitride insulating protective layer 106 was formed to a thickness of about 300 nm, as shown in FIG. 2C, by plasma CVD. An ink jet recording head substrate 100 was thus formed.

Figure 2D:
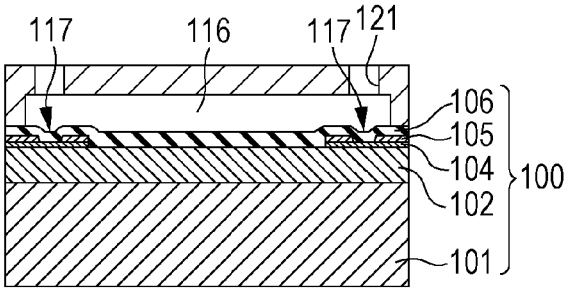
Figure 2E:
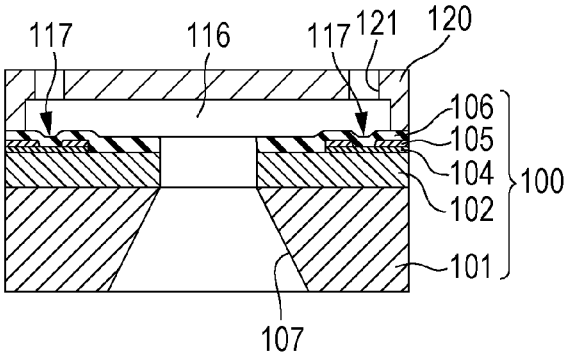

Subsequently, a liquid flow channel member 120 in which a liquid flow channel 116 was to be formed was formed on the ink jet recording head substrate 100, and ink ejection openings 121 were formed in the liquid flow channel member 120 corresponding to the positions of the thermal operation portions 117, as shown in FIG. 2D. Then, an ink supply port 107 was formed so as to pass through the base substrate 101 and the heat accumulation layer 102 and communicate with the liquid flow channel 116, as shown in FIG. 2E. Thus, the ink jet recording head 1 was completed.

The porosity of the porous SiOCH heat accumulation layer 102 formed on the base substrate 101 was measured by observation through a transmission electron microscope. Also, the thermal conductivity of the heat accumulation layer 102 was estimated by the 3ω method. The results are shown in Table 1.

The electrothermal conversion portions 108 of the ink jet recording head 1 produced through the above-described process were operated under the following conditions, and the durability to thermal stress was estimated by applying breaking pulses.

Driving frequency: 10 KHz

Driving pulse width: 2 μs

Driving voltage: 1.3 times of the bubbling voltage at which ink was ejected

The durability to thermal stress was evaluated according to the following criteria:

Excellent: durable to $5.0\times10^9$ pulses

Good: durable to pulses in the range of $3.0\times10^9$ to less than $5.0\times10^9$ Bad: broken by less than $3.0\times10^9$ pulses The samples were comprehensively evaluated in terms of thermal conductivity and durability to thermal stress according to the following criteria:

Excellent: When having a thermal conductivity of less than 1.00 $W\cdot K^{-1}\cdot m^{-1}$ and being durable to $5.0\times10^9$ pulses or more Good: When having a thermal conductivity of less than 1.00 $W\cdot K^{-1}\cdot m^{-1}$ and broken in the test for durability to thermal stress using pulses in the range of $3.0\times10^9$ to less than $5.0\times10^9$, or when having a thermal conductivity in the range of 1.00 $W\cdot K_{-1}\cdot m^{-1}$ to less than 1.30 $W\cdot K_{-1}\cdot m^{-1}$ and being durable to thermal stress of $5.0\times10^9$ pulses or more.

Bad: Cases other than the above cases

The results are shown in Table 1 together. For comparison, a SiO film formed by the sol-gel process disclosed in U.S. Pat. No. 7,390,078 and a known SiO film formed by thermal CVD using silane and oxygen gas were evaluated.

TABLE 1

| Heat accumulation layer | Gas ratio Formula (A) | Gas ratio Formula (B) | Porosity (%) | Thermal conductivity ($W\cdot K^{-1}\cdot m^{-1}$) | Durability evaluated by thermal stress | Comprehensive evaluation |
|---|---|---|---|---|---|---|
| Sol-gel-processed SiO | | | | 0.30 | Bad | Bad |
| Known CVD-SiO | | | | 1.30 | Excellent | Bad |

TABLE 1-continued

| Heat accumulation layer | | Gas ratio Formula (A) | Formula (B) | Porosity (%) | Thermal conductivity ($W \cdot K^{-1} \cdot m^{-1}$) | Durability evaluated by thermal stress | Comprehensive evaluation |
|---|---|---|---|---|---|---|---|
| SiOCH | 1A | 0.60 | 0.40 | 20 | 1.16 | Excellent | Good |
| | 1B | 0.50 | 0.50 | 30 | 0.95 | Excellent | Excellent |
| | 1C | 0.35 | 0.65 | 40 | 0.87 | Excellent | Excellent |
| | 1D | 0.10 | 0.90 | 60 | 0.58 | Excellent | Excellent |
| | 1E | 0.05 | 0.95 | 65 | 0.42 | Good | Good |

In terms of durability to thermal stress, the SiOCH films formed under the conditions of 1A to 1D shown in Table 1 were evaluated as excellent, and the SiOCH film formed under the conditions of 1E shown in Table 1 was evaluated as good. These results suggest that the samples formed under these conditions are sufficiently durable to thermal stress. The reason why the sample of conditions 1E was evaluated as good is probably that the mechanical strength thereof was reduced due to the high porosity thereof. The heat accumulation layer formed by the sol-gel process disclosed in U.S. Pat. No. 7,390,078 was evaluated as bad. This is probably because the heating resistor layer was broken by the thermal expansion and contraction of the heat accumulation layer resulting from the evaporation of the residual solvent from the layer.

The comprehensive evaluation in terms of thermal conductivity and durability to thermal stress were excellent for 1B, 1C and 1D, and good for 1A and 1E.

These results suggest that the SiOCH films of the present Example are porous, and have lower thermal conductivities and higher durabilities to thermal stress than heat accumulation layers of SiO formed by a known CVD process. The results of the comprehensive evaluation show that the desirable porosity of the SiOCH film is in the range of 30% to 60%. Hence, in the case of the present Example, the gas flow rate of formula (A) to formula (B) is desirably in the range of 10:90 to 50:50. Unlike the case of the sol-gel process, the heat accumulation layers of the present Example, which were formed by P-CVD being a gas phase process, do not contain a residual solvent. Such a heat accumulation layer is unlikely to release solvent vapor when the ink jet recording head is operated, and accordingly there is little risk of expansion and contraction of the heat accumulation layer. Accordingly, the problem is reduced that the heating resistor on the accumulation layer is broken and results in open circuit in the head.

Thus, an ink jet recording head substrate is provided which can operate at low power with reliability.

Example 2

Heat accumulation layers 102 were formed under the deposition conditions of 2A to 2F shown in Table 2 using tetrafluorosilane ($SiF_4$), oxygen gas and hydrogen gas as raw material gases instead of those used in Example 1. Each of the resulting heat accumulation layers is assumed to be a porous SiOFH film having a cyclic siloxane structure expressed by the following formula (D).

(D)

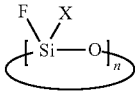

In formula (D), X represents F or H, or a linkage bound to another cyclic siloxane structure via —O—. According to observation through a transmission electron microscope, the pore size was in the range of 0.1 nm to 3 nm. The number n of siloxane units in the cyclic skeleton was estimated in the range of 3 to 20 from the pore size. Then, ink jet recording heads were produced in the same process as in Example 1.

The ink jet recording head substrates and ink jet recording heads produced in the above process were subjected to measurements for the porosity and thermal conductivity of the heat accumulation layer 102 in the same manner as in Example 1, and the heat accumulation layer was comprehensively evaluated together with the durability to thermal stress. The results are shown in Table 2.

TABLE 2

| Heat accumulation layer | | Deposition condition (Gas flow rate: sccm) $SiF_4$ | $H_2$ | $O_2$ | Porosity (%) | Thermal conductivity ($W \cdot K^{-1} \cdot m^{-1}$) | Durability evaluated by thermal stress | Comprehensive evaluation |
|---|---|---|---|---|---|---|---|---|
| Sol-gel-processed SiO | | | | | | 0.30 | Bad | Bad |
| Known CVD-SiO | | | | | | 1.30 | Excellent | Bad |
| SiOFH | 2A | 50 | 60 | 48 | 20 | 1.18 | Excellent | Good |
| | 2B | 50 | 50 | 40 | 30 | 0.98 | Excellent | Excellent |
| | 2C | 50 | 40 | 32 | 40 | 0.89 | Excellent | Excellent |
| | 2D | 50 | 20 | 16 | 60 | 0.61 | Excellent | Excellent |
| | 2E | 50 | 15 | 12 | 65 | 0.45 | Excellent | Excellent |
| | 2F | 50 | 10 | 8 | 70 | 0.41 | Good | Good |

In terms of durability to thermal stress, the SiOFH films formed under the conditions of 2A to 2E were evaluated as excellent, and the SiOFH film formed under the conditions of 2F was evaluated as good. These results suggest that the samples formed under these conditions are sufficiently durable to thermal stress. The reason why the sample of conditions 2F was evaluated as good is probably that the mechanical strength thereof was reduced due to the high porosity thereof.

The sample of 2E, whose porosity was 65%, was evaluated as excellent. This is because the mechanical strength thereof was higher than that of the SiOCH film (1E) in Example 1 having the same porosity. In view of mechanism for increasing the mechanical strength of the heat accumulation layer, it is assumed that the film density (density of the entirety of the film except pores) of the SiOFH film is increased to more than that of the SiOCH film having Si—C bonds by increasing the number of Si—F bonds. Consequently, the mechanical strength of the SiOFH film was increased to more than that of the SiOCH film of Example 1. The comprehensive evaluations were excellent for 2B to 2E shown in Table 2, and good for 2A and 2F shown in Table 2.

These results suggest that the SiOFH films of the present Example containing a cyclic siloxane are porous, and have lower thermal conductivities and higher durabilities to thermal stress than heat accumulation layers of SiO formed by a known CVD process. The results also show that the desirable porosity of the SiOFH film is in the range of 30% to 65%. In the present Example, hence, it is desirable that tetrafluorosilane, hydrogen gas and oxygen gas be used in the proportions in which the flow rates of hydrogen gas and oxygen gas are 50 to 15 sccm and 40 to 12 sccm, respectively, relative to the flow rate of tetrafluorosilane of 50 sccm.

Example 3

Heat accumulation layers 102 were formed under the deposition conditions of 3A to 3F shown in Table 3 using tetrafluorosilane ($SiF_4$), trimethylsilane (3MS) and oxygen gas as raw material gases instead of those used in Example 1. Each of the resulting heat accumulation layers is assumed to be a porous SiOCHF film having a cyclic siloxane structure expressed by the following formula (E).

(E)

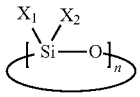

In formula (E), $X_1$ and $X_2$ each represent H, F, $CH_3$, or a linkage bound to another cyclic siloxane via —$CH_2$— or —O—. According to observation through a transmission electron microscope, the pore size was in the range of 0.1 nm to 3 nm. The number n of siloxane units in the cyclic skeleton was estimated in the range of 3 to 20 from the pore size. Then, ink jet recording heads were produced in the same process as in Example 1.

The ink jet recording head substrates and ink jet recording heads produced in the above process were subjected to measurements for the porosity and thermal conductivity of the heat accumulation layer 102 in the same manner as in Example 1, and the heat accumulation layer was comprehensively evaluated together with the durability to thermal stress. The results are shown in Table 3.

TABLE 3

| Heat accumulation layer | | Deposition conditions: Deposition Temperature (° C.) | Gas ratio (SiF4/3MS) | Porosity (%) | Thermal conductivity ($W \cdot K^{-1} \cdot m^{-1}$) | Durability evaluated by thermal stress | Comprehensive evaluation |
|---|---|---|---|---|---|---|---|
| Sol-gel-processed SiO | | | | | 0.30 | Bad | Bad |
| Known CVD-SiO | | | | | 1.30 | Excellent | Bad |
| SiOCHF | 3A | 400 | 0.5 | 20 | 1.15 | Excellent | Good |
| | 3B | 400 | 1.0 | 30 | 0.96 | Excellent | Excellent |
| | 3C | 350 | 0.5 | 40 | 0.88 | Excellent | Excellent |
| | 3D | 350 | 1.0 | 60 | 0.57 | Excellent | Excellent |
| | 3E | 300 | 1.0 | 65 | 0.44 | Excellent | Excellent |
| | 3F | 250 | 1.0 | 70 | 0.40 | Good | Good |

In terms of durability to thermal stress, the SiOCHF films formed under the conditions of 3A to 3E were evaluated as excellent, and the SiOCHF film formed under the conditions of 3F was evaluated as good. These results suggest that the samples formed under these conditions are sufficiently durable to thermal stress. The reason why the sample of conditions 3F was evaluated as good is probably that the mechanical strength thereof was reduced due to the high porosity thereof.

The sample of 3E, whose porosity was 65%, was evaluated as excellent. This is because the mechanical strength thereof was higher than that of the SiOCH film (1E) in Example 1 having the same porosity. As with Example 2, the increase in mechanical strength of the SiOCHF film results from the addition of F.

The comprehensive evaluations were excellent for 3B to 3E, and good for 3A and 3F. These results suggest that the SiOCHF films of the present Example have lower thermal conductivities and higher durabilities to thermal stress than heat accumulation layers of SiO formed by a known CVD process. The SiOCHF film formed in the present Example exhibits good performance when the porosity is in the range 30% to 65%.

Example 4

Heat accumulation layers 102 were formed to a thickness in the range of 0.5 μm to 2 μm under the deposition conditions of 4A to 4F shown in Table 4 using trimethylsilane (3MS), nitrogen trifluoride ($NF_3$) and oxygen gas as raw material gases instead of those used in Example 1. Each of the resulting heat accumulation layers is assumed to be a porous SiOCHNF film having a cyclic siloxane structure expressed by the following formula (F).

(F)

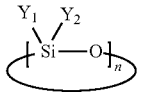

In formula (F), $Y_1$ and $Y_2$ each represent H, F, $CH_3$, $NH_2$, NHF or $NF_2$, or a linkage bound to another cyclic siloxane via —$CH_2$—NH—, —NF— or —O—. Z Represents O, NH or NF, and at least one of Z's in the skeleton is O. The pore size was 0.1 nm to 3 nm, and the number n of the siloxane units was 3 to 20. Then, the ink jet recording heads were produced in the same process as in Example 1.

The ink jet recording head substrates and ink jet recording heads produced in the above process were subjected to measurements for the porosity and thermal conductivity of the heat accumulation layer 102 in the same manner as in Example 1, and the heat accumulation layer was comprehensively evaluated together with the durability to thermal stress. The results are shown in Table 4.

TABLE 4

| Heat accumulation layer | | Deposition conditions: Deposition Temperature (° C.) | Deposition conditions: Gas ratio (3MS/NF3) | Porosity (%) | Thermal conductivity ($W \cdot K^{-1} \cdot m^{-1}$) | Durability evaluated by thermal stress | Comprehensive evaluation |
|---|---|---|---|---|---|---|---|
| Sol-gel-processed SiO | | | | | 0.30 | Bad | Bad |
| Known CVD-SiO | | | | | 1.30 | Excellent | Bad |
| SiOCHNF | 4A | 400 | 0.5 | 20 | 1.14 | Excellent | Good |
| | 4B | 400 | 1.0 | 30 | 0.93 | Excellent | Excellent |
| | 4C | 350 | 0.5 | 40 | 0.85 | Excellent | Excellent |
| | 4D | 350 | 1.0 | 60 | 0.56 | Excellent | Excellent |
| | 4E | 300 | 1.0 | 65 | 0.40 | Excellent | Excellent |
| | 4F | 300 | 0.5 | 70 | 0.37 | Good | Good |

In terms of durability to thermal stress, the SiOCHNF films formed under the conditions of 4A to 4E were evaluated as excellent, and the SiOCHNF film formed under the conditions of 4F was evaluated as good. These results suggest that the samples formed these conditions are sufficiently durable to thermal stress. The reason why the sample of conditions 4F was evaluated as good is probably that the mechanical strength thereof was reduced due to the high porosity thereof.

The sample of 4E, whose porosity was 65%, was evaluated as excellent. This is because the mechanical strength thereof was higher than that of the SiOCH film (1E) in Example 1 having the same porosity. In the mechanism for increasing the mechanical strength of the SiOCHNF film, the number of Si—F or Si—N bonds is increased and some of the —Si—O— units are substituted with —Si—N—, by adding N and F to the film. The film density (density of the entirety of the film except pores) of the SiOCHNF film is thus increased, and consequently, the mechanical strength thereof is increased to more than that of the films to which N and F are not added.

The comprehensive evaluations were excellent for 4B to 4E, and good for 4A and 4F. These results suggest that the SiOCHNF films of the present Example have lower thermal conductivities and higher durabilities to thermal stress than heat accumulation layers of SiO formed by a known CVD process. The SiOCHNF film formed in the present Example exhibits good performance when the porosity is in the range 30% to 65%.

Example 5

A process will now be described for manufacturing an ink jet recording head substrate according to another embodiment. FIGS. 3A to 3F are schematic sectional views illustrating the process for manufacturing the ink jet recording head 1 shown in FIG. 1B.

Figure 3A:
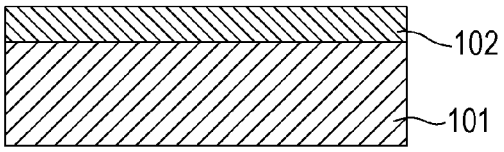
FIGS. 3A to 3F are schematic sectional views illustrating a process for manufacturing the ink jet recording head shown in FIG. 1B.
Figure 3B:
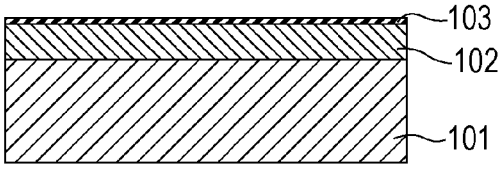
Figure 3C:
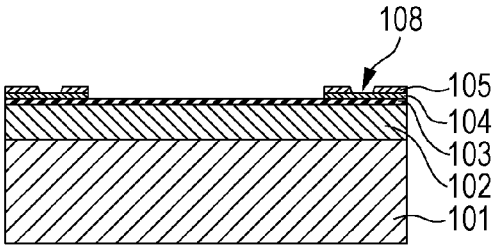
Figure 3D:
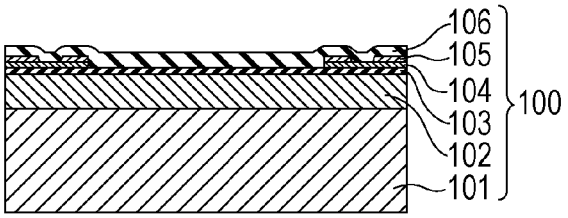
Figure 3E:
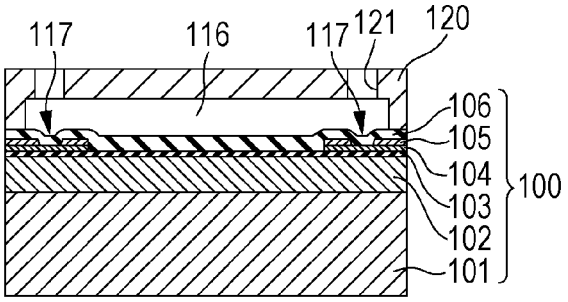
Figure 3F:
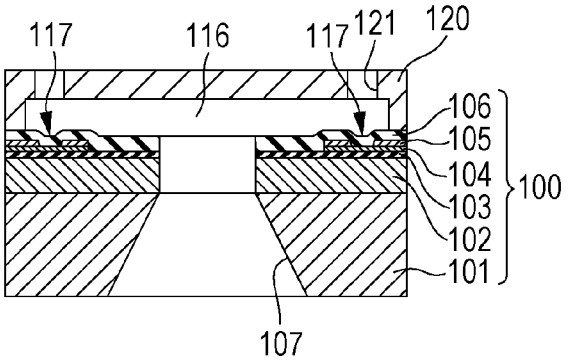

A heat accumulation layer 102 was formed of a porous cyclic siloxane film on the base substrate 101 in the same manner as in Examples 1 to 4 (FIG. 3A). Next, as shown in FIG. 3B, a silicon nitride film was formed to a thickness of 10 nm on the heat accumulation layer 102, using monosilane gas and ammonia gas, thus sealing the pores in the surface of the heat accumulation layer. Thus a 10 nm thick pore-sealing film 103 was formed by pore-sealing treatment for planarization. The pore-sealing treatment reduces the surface roughness of the electrothermal conversion portions 108 of the heating resistor layer 104 that will subsequently formed, and of the thermal operation portions 117 of the insulating protective layer 106 right above the electrothermal conversion portions, which will come in contact with the ink. By reducing the surface roughness, thermal diffusion in the heat operation portion 117 when the electrothermal conversions have been operated 108 is reduced. The pore-sealing film 103 merely fill the pores in the surface of the heat accumulation layer 102 and does not therefore affect heat conduction of the entirety of the heat accumulation layer including the pore-sealing film 103.

Then, the heating resistor layer 104, the wiring layer 105, the insulating protective layer 106 and the liquid flow channel member 120 for the liquid flow channel 116 were further formed over the pore-sealing film 103 in the same manner as in Example 1, and a through hole was formed for the ink supply port 107 (FIGS. 3C to 3F). The ink jet recording head 1 is thus produced through the above-described process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-140397, filed Jul. 8, 2014, which is hereby incorporated by reference herein in its entirety.

What is claimed is:

1. An ink jet recording head substrate comprising:

a base substrate;

a heat accumulation layer overlying the base substrate, the heat accumulation layer including a porous cyclic siloxane film formed by a gas-phase process;

a heating resistor layer overlying the heat accumulation layer, the heating resistor layer including an electrothermal conversion portion;

a wiring layer electrically connected to the heating resistor layer; and an insulating protective layer covering the heating resistor layer and the wiring layer.

2. The ink jet recording head substrate according to claim 1, wherein the cyclic siloxane film is made of a material having a cyclic skeleton expressed by (—Si—O—)n, wherein the number n of (—Si—O—) units is in the range of 3 to 20.

3. The ink jet recording head substrate according to claim 2, wherein the material of the cyclic siloxane film contains Si, O, C and H.

4. The ink jet recording head substrate according to claim 2, wherein the material of the cyclic siloxane film contains Si, O, F and H.

5. The ink jet recording head substrate according to claim 2, wherein the material of the cyclic siloxane film contains Si, O, C, H and F.

6. The ink jet recording head substrate according to claim 2, wherein the material of the cyclic siloxane film contains Si, O, C, H, N and F.

7. The ink jet recording head substrate according to claim 3, wherein the cyclic siloxane film has a porosity in the range of 30% to 60%.

8. The ink jet recording head substrate according to claim 4, wherein the cyclic siloxane film has a porosity in the range of 30% to 65%.

9. The ink jet recording head substrate according to claim 1, wherein the heat accumulation layer further includes a pore-sealing film sealing the pores in the surface of the cyclic siloxane film.

10. The ink jet recording head substrate according to claim 9, wherein the pore-sealing film is made of silicon nitride.

11. A method for manufacturing an ink jet recording head substrate, the method comprising:

forming a heat accumulation layer over a base substrate;

forming a heating resistor layer including an electrothermal conversion portion on the heat accumulation layer;

forming a wiring layer so as to be electrically connected to the heating resistor layer; and forming an insulating protective layer so as to cover the heating resistor layer and the wiring layer, wherein the forming of the heat accumulation layer includes depositing a porous cyclic siloxane film by a gas-phase process.

12. The method according to claim 11, wherein the deposition of the cyclic siloxane film is performed by plasma CVD using diethoxymethylsilane and norbornadiene as raw material gas.

13. The method according to claim 12, wherein the ratio of the flow rate of the diethoxymethylsilane to the flow rate of the norbornadiene is in the range of 10:90 to 50:50.

14. The method according to claim 11, wherein the deposition of the cyclic siloxane film is performed by plasma CVD using tetrafluorosilane, oxygen gas and hydrogen gas.

15. The method according to claim 14, wherein the tetrafluorosilane, the hydrogen gas and the oxygen gas are used in the proportions in which the flow rates of the hydrogen gas and the oxygen gas are 50 to 15 sccm and 40 to 12 sccm, respectively, relative to the flow rate of the tetrafluorosilane of 50 sccm.

16. The method according to claim 11, wherein the deposition of the cyclic siloxane film is performed by plasma CVD using trimethylsilane, tetrafluorosilane and oxygen gas as material gas.

17. The method according to claim 11, wherein the deposition of the cyclic siloxane film is performed by a plasma CVD using trimethylsilane, nitrogen trifluoride and oxygen gas as raw material gas.

18. The method according to claim 11, wherein the forming of the heat accumulation layer further includes forming a pore-sealing film on the cyclic siloxane film, thereby sealing the pores in the surface of the cyclic siloxane film.

19. The method according to claim 18, wherein the pore-sealing film is formed of silicon nitride.

20. An ink jet recording head comprising:

the ink jet recording head substrate as set forth in claim 1, wherein the ink jet recording head substrate has an ink supply port passing therethrough, and the portion of the surface of the insulating protective film right above the electrothermal conversion portion acts as a thermal operation portion; and a liquid flow channel member having an ink ejection opening corresponding to the position of the thermal operation portion, the liquid flow channel member defining a liquid flow channel continuing from the ink supply port to the ink ejection opening via the thermal operation portion.

* * * * *